US009392867B2

(12) United States Patent
Bresselschmidt

(10) Patent No.: US 9,392,867 B2
(45) Date of Patent: Jul. 19, 2016

(54) METHOD OF PRODUCING AN ORAL HYGIENE IMPLEMENT HAVING FLEXIBLE WINGS

(71) Applicant: The Gillette Company, Boston, MA (US)

(72) Inventor: Andreas Bresselschmidt, Weiterstadt (DE)

(73) Assignee: THE GILLETTE COMPANY, Boston, MA (US)

( * ) Notice: Subject to any disclaimer, the term of this patent is extended or adjusted under 35 U.S.C. 154(b) by 0 days.

(21) Appl. No.: 14/618,359

(22) Filed: Feb. 10, 2015

(65) Prior Publication Data

US 2015/0150369 A1 Jun. 4, 2015

Related U.S. Application Data

(63) Continuation of application No. 13/523,539, filed on Jun. 14, 2012, now abandoned.

(60) Provisional application No. 61/497,135, filed on Jun. 15, 2011.

(51) Int. Cl.

| | |
|---|---|
| ***A46D 3/00*** | (2006.01) |
| ***A46B 7/06*** | (2006.01) |
| ***A46B 9/04*** | (2006.01) |
| ***A46B 3/06*** | (2006.01) |
| ***A46B 5/00*** | (2006.01) |
| ***A46B 7/00*** | (2006.01) |
| ***A46B 1/00*** | (2006.01) |
| ***A46B 3/04*** | (2006.01) |

(Continued)

(52) U.S. Cl.

CPC . *A46D 3/005* (2013.01); *A46B 1/00* (2013.01); *A46B 3/04* (2013.01); *A46B 3/06* (2013.01); *A46B 5/0025* (2013.01); *A46B 7/00* (2013.01); *A46D 1/04* (2013.01); *A46B 3/005* (2013.01); *A46B 2200/1066* (2013.01); *A46D 3/00* (2013.01); *A46D 3/04* (2013.01)

(58) Field of Classification Search

CPC ..... A46D 3/00; A46D 3/005; A46D 3/04; A46B 3/00; A46B 3/005; A46B 3/04; A46B 7/02; A46B 7/06; A46B 9/04

USPC ..... 15/167.1, 201; 300/21

See application file for complete search history.

(56) References Cited

U.S. PATENT DOCUMENTS 2,592,296 A * 4/1952 Kutik ..... 264/318
4,472,853 A 9/1984 Rauch (Continued)

FOREIGN PATENT DOCUMENTS

DE 10235642 * 2/2004
DE 102006059250 * 6/2008

(Continued)

*Primary Examiner* — Mark Spisich
(74) *Attorney, Agent, or Firm* — James E. Oehlenschlager

(57) ABSTRACT

An oral care implement has a body made of a first material. The body has a handle, a head support, and a neck extending between the handle and the head support. The head support has a recess therein, and the recess has a bottom face and a side face. A head has a first head section and a second head section, and supports a plurality of contact elements. The first head section is disposed in the recess and attached thereto, and the second head section is attached to the first head section and unattached to the body.

4 Claims, 10 Drawing Sheets

(51) Int. Cl.

| | |
|---|---|
| ***A46D 1/04*** | (2006.01) |
| *A46D 3/04* | (2006.01) |
| *A46B 3/00* | (2006.01) |

(56) References Cited

U.S. PATENT DOCUMENTS

| | | | | | |
|---|---|---|---|---|---|
| 4,776,054 | A | * | 10/1988 | Rauch | 15/167.1 |
| 4,802,255 | A | | 2/1989 | Breuer et al. | |
| 5,268,005 | A | | 12/1993 | Suhonen | |
| 5,313,909 | A | | 5/1994 | Tseng et al. | |
| 5,722,106 | A | | 3/1998 | Masterman et al. | |
| 5,813,079 | A | | 9/1998 | Halm | |
| 5,815,872 | A | | 10/1998 | Meginniss, III et al. | |
| 5,836,769 | A | | 11/1998 | Spencer | |
| 5,970,564 | A | * | 10/1999 | Inns et al. | 15/201 |
| 5,980,542 | A | | 11/1999 | Saldivar | |
| 6,018,840 | A | | 2/2000 | Guay et al. | |
| 6,036,277 | A | * | 3/2000 | Weihrauch | 300/21 |
| 6,058,541 | A | | 5/2000 | Masterman et al. | |
| 6,102,923 | A | | 8/2000 | Murayama | |
| 6,151,745 | A | | 11/2000 | Roberts et al. | |
| 6,389,636 | B1 | | 5/2002 | Savill | |
| 6,402,768 | B1 | | 6/2002 | Liebel | |
| 6,475,553 | B2 | | 11/2002 | Guay et al. | |
| 6,553,604 | B1 | | 4/2003 | Braun et al. | |
| 7,024,717 | B2 | | 4/2006 | Hilscher et al. | |
| 7,086,111 | B2 | | 8/2006 | Hilscher et al. | |
| 7,207,080 | B2 | | 4/2007 | Hilscher et al. | |
| 2001/0013152 | A1 | * | 8/2001 | Meyer et al. | 15/193 |
| 2002/0129454 | A1 | | 9/2002 | Hilscher et al. | |
| 2002/0182282 | A1 | | 12/2002 | Lanvers | |
| 2004/0117934 | A1 | | 6/2004 | Pfenniger et al. | |
| 2004/0134007 | A1 | | 7/2004 | Davies | |
| 2004/0154112 | A1 | | 8/2004 | Braun et al. | |
| 2004/0255416 | A1 | | 12/2004 | Hohlbein | |
| 2005/0000043 | A1 | | 1/2005 | Chan et al. | |
| 2005/0000049 | A1 | | 1/2005 | Hohlbein | |
| 2005/0038461 | A1 | | 2/2005 | Phillips | |
| 2005/0053895 | A1 | | 3/2005 | Pinyayev et al. | |
| 2005/0053896 | A1 | | 3/2005 | Pinyayev et al. | |
| 2005/0166344 | A1 | | 8/2005 | Hohlbein et al. | |
| 2005/0210612 | A1 | | 9/2005 | Hohlbein et al. | |
| 2006/0010628 | A1 | | 1/2006 | Moskovich | |
| 2006/0026784 | A1 | | 2/2006 | Moskovich et al. | |
| 2006/0052806 | A1 | | 3/2006 | Xi et al. | |
| 2006/0080794 | A1 | | 4/2006 | Punshon | |
| 2006/0195995 | A1 | | 9/2006 | Moskovich et al. | |
| 2006/0200925 | A1 | | 9/2006 | Moskovich et al. | |
| 2006/0272112 | A9 | | 12/2006 | Braun et al. | |
| 2007/0049956 | A1 | | 3/2007 | Mythen | |
| 2007/0140959 | A1 | | 6/2007 | Park et al. | |
| 2007/0251040 | A1 | | 11/2007 | Braun et al. | |
| 2008/0127440 | A1 | | 6/2008 | Fischer | |
| 2008/0189888 | A1 | | 8/2008 | Hohlbein | |
| 2008/0244849 | A1 | | 10/2008 | Moskovich et al. | |
| 2009/0246430 | A1 | | 10/2009 | Kriegel et al. | |
| 2010/0028512 | A1 | | 2/2010 | Kriegel et al. | |
| 2011/0099737 | A1 | | 5/2011 | Bauernfeind | |
| 2012/0110763 | A1 | | 5/2012 | Jungnickel et al. | |
| 2013/0019425 | A1 | | 1/2013 | Bresselschmidt | |
| 2014/0310901 | A1 | * | 10/2014 | Geiberger et al. | 15/167.1 |

FOREIGN PATENT DOCUMENTS

| | | | |
|---|---|---|---|
| DE | 102009009034 | * | 8/2010 |
| EP | 2229917 | | 9/2010 |
| EP | 2295220 | * | 3/2011 |
| JP | 3-215211 | * | 9/1991 |
| JP | 9-182632 | * | 7/1997 |
| WO | 03/017801 | * | 6/2003 |
| WO | WO2011051920 | | 5/2011 |
| WO | WO2012040146 | | 3/2012 |
| WO | WO2012040181 | | 3/2012 |
| WO | WO2012109420 | | 8/2012 |

* cited by examiner

METHOD OF PRODUCING AN ORAL HYGIENE IMPLEMENT HAVING FLEXIBLE WINGS

CROSS REFERENCE OF RELATED APPLICATION

This application is a continuation of U.S. application Ser. No. 13/523,539 filed Jun. 14, 2012, now abandoned which claims the benefit of priority to U.S. Provisional Application No. 61/497,135, filed Jun. 15, 2011, which are incorporated by reference herein in its entirety.

FIELD OF THE INVENTION

The present invention pertains to a personal hygiene device and a method of producing the same.

BACKGROUND OF THE INVENTION

The utilization of toothbrushes to clean one's teeth has long been known. Several toothbrushes currently available have flat heads with bristle tufts attached thereto. Some view this configuration as problematic due to the fact that teeth are generally not arranged as a flat surface. Typically, the surface of a tooth comprises curvature. Additionally, teeth are generally arranged in an arcuate fashion in the oral cavity.

To compensate for the curvature of the individual teeth and/or the arrangement of the teeth within the oral cavity, some toothbrushes have been introduced which include flexible heads. Some, flexible head toothbrushes include a plurality of segments of polypropylene linked together by a softer elastomeric material. The softer elastomeric material can allow the segments of polypropylene to move with respect to one another. The relative movement of the segments of polypropylene can allow the toothbrush head to adjust to the curvature and contour of the teeth within the oral cavity.

However, these brushes may be difficult to manufacture due to the complex arrangement of the segments of polypropylene within the head. For example, in general, the segments of polypropylene may be injection molded in a first station and then moved to a second station for the injection molding of the elastomeric material. In order to maintain the proper spacing between the segments of polypropylene, a mechanism for holding such segments of polypropylene may be required.

Recently, some manufacturers have reviewed the possibility of utilizing a single material in the head which allows for such flexibility. In order to properly attach the head to the handle, it has been proposed to include the material utilized for the head in a portion of the handle. Unfortunately, such a design can be complex to manufacture.

Accordingly, a need exists for a personal hygiene implement having a flexible head which also has a facilitated manufacturing process.

SUMMARY OF THE INVENTION

An oral care implement constructed in accordance with the present invention may provide facilitated manufacturing process and configurations which facilitate such manufacturing. In some embodiments, an oral care implement comprises a body comprising a first material. The body has a handle, a head support, and a neck extending between the handle and the head support, and the head support has a recess therein. The recess has a bottom face and a side face. A head has a first head section and a second head section, and the head supports a plurality of contact elements. The first head section is disposed in the recess and attached thereto, and the second head section is attached to the first head section and unattached to the body.

In some embodiments, a method of manufacturing oral care implements in accordance with the present invention comprises the steps of obtaining a plurality of filaments having a first end and a second end. Forming a melted mass of material at a second end of the filaments. Capturing the melted mass via injection molding of a first material, the injection molding of the first material forming a head having a first head section and a second head section. Injection molding a second material over the first head section thereby forming a body having a handle, a neck, and a head support.

DETAILED DESCRIPTION OF THE INVENTION

Definitions:

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

As used herein, "oral hygiene implement" refers to any device which can be utilized for the purposes of oral hygiene. Some suitable examples of such devices include toothbrushes (both manual and power), flossers (both manual and power), water picks, and the like.

Description:

For ease of explanation, the oral hygiene implement described hereafter shall be a manual toothbrush; however, as stated above, an oral hygiene implement constructed in accordance with the present invention is not limited to a manual toothbrush construction. For example, the oral hygiene implement may comprise a refill for use on a power toothbrush handle.

Figure 1A:
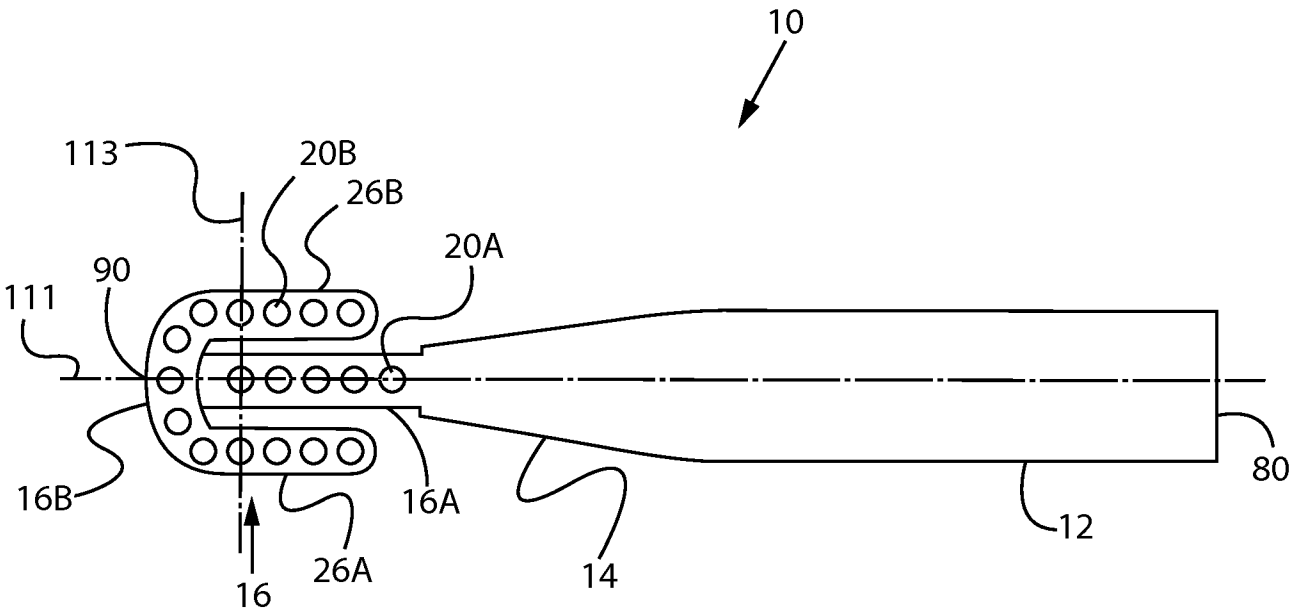
FIG. 1A is a plan view showing an oral hygiene implement, e.g. a toothbrush, constructed in accordance with the present invention.

As shown in FIG. 1A, a toothbrush 10 comprises a handle 12, a head 16, and a neck 14 extending between the handle 12 and the head 16. The head 16 may comprise a first contact element field 20A which extends from a first surface of a first head section 16A. The first contact element field may comprise a plurality of contact elements, e.g. bristle tufts.

The head 16 comprises the first head section 16A and a second head section 16B. As shown, the second head section 16B may comprise flexible wings 26A and 26B disposed on either side of the first head section 16A. The flexible wings 26A and 26B may be positioned superjacent to the first head section 16A. The second head section 16B may comprise a second contact element field 20B which extends from a first surface of the second head section 16B. The second contact element field 20B may comprise a plurality of contact elements, e.g. bristle tufts.

The flexible wings 26A and 26B of the toothbrush 10 can allow for adjustment of the contact element field 20B to the curvature of the teeth and the contour of the teeth within the oral cavity.

A tongue cleaner, soft tissue cleanser, massaging element, or the like, may be disposed on a second surface of the first head section 16A and/or a second surface of the second head section 16B. The tongue cleaners, soft tissue cleansers, massaging elements, or the like, are discussed hereafter. The toothbrush 10 may comprise a distal end 80 and a proximal end 90. The distal end 80 may be disposed at an end of the handle 12 while the proximal end may be disposed at an end of the first head section 16A. Although not shown, the first head section 16A may extend underneath the second head section 16B.

The toothbrush 10 may comprise a longitudinal axis 111 which extends generally along the length of the first head section 16A and may extend along the length of the handle 12. A lateral axis 113 extends generally perpendicular to the longitudinal axis 111 and may be generally perpendicular, in at least one direction, to the contact elements of the first head section 16A. In embodiments where the contact elements of the first head section 16A comprise a compound angle, the lateral axis 113 may still be generally perpendicular (within plus or minus 40 degrees) to the contact elements of the first head section 16A. As shown in FIG. 1C, a transverse axis 115 extends generally perpendicular to the longitudinal axis 111 and the lateral axis 113 and may be generally parallel to an extension direction of the contact elements of the first head section 16A. Where the contact elements of the first head section 16A are angled, the transverse axis 115 may still be generally parallel (within plus or minus 40 degrees) of the extension direction of the contact elements.

Figure 1B:
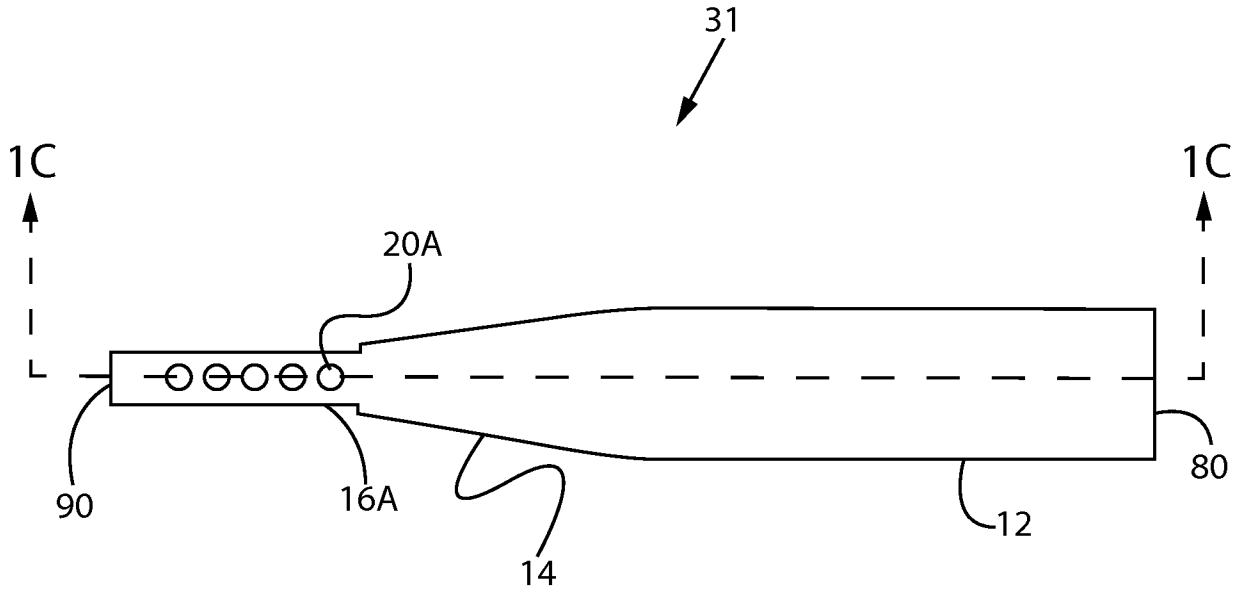
FIG. 1B is a plan view showing the toothbrush of FIG. 1A with a second head portion removed for ease of explanation.
Figure 1C:
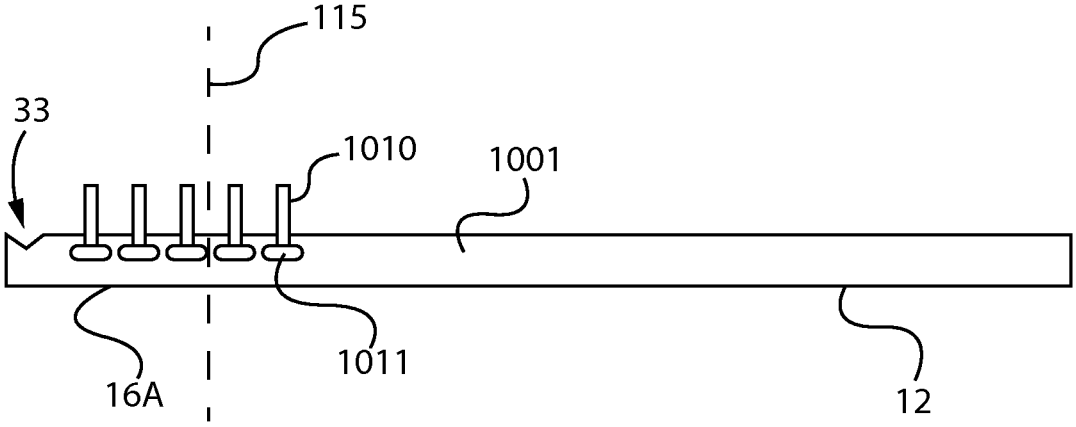
FIG. 1C is a cross sectional view showing the toothbrush of FIG. 1B, the cross section being taken along line 1C-1C.

Referring to FIG. 1B, in a first embodiment, a body 31 which includes the handle 12, the neck 14, and the first head section 16A may be produced in a first injection molding step from a first material, e.g. polypropylene. After the first injection molding step, the contact elements may be mechanically attached to the first head section 16A. The mechanical attachment of the contact elements can occur before or after the attachment of the second head section 16B to the first head section 16A. The mechanical attachment of the contact elements can be any suitable known method. As an example, staples may be utilized to mechanically attach the contact elements in the first head section 16A.

Alternatively, the contact elements of the first contact element field 20A may be attached to the first head section 16A via injection molding. For example, as shown in FIG. 1C, a contact element may have a contact portion 1010 and an anchor portion 1011. The anchor portion 1011 may be unitary with the contact portion 1010. For example, assuming the contact elements are bristle tufts, a plurality of bristle filaments may be inserted into a holding bar which allows an end of the filaments to be deformed thereby forming an anchor portion 1011. The anchor portion 1011 can then be over injection molded by a first material 1001 in a first injection molding step. Because the anchor has a wider cross section than the contact portion 1010, an undercut is formed thereby locking the contact element in the first material 1001. Any other suitable attachment mechanism may be utilized to attach the contact elements to the first head section 16A.

Still referring to FIG. 1C, the first head section 16A may be provided with a receiving section 33. The receiving section 33 may be any suitable shape. For example, the receiving section 33 may be configured with a first undercut, and the second head section 16B may comprise a second undercut which engages the first undercut to allow an interlock between the second head section 16B and the first head section 16A. The first and second undercuts are discussed further hereafter with regard to FIG. 1E.

Figure 1D:
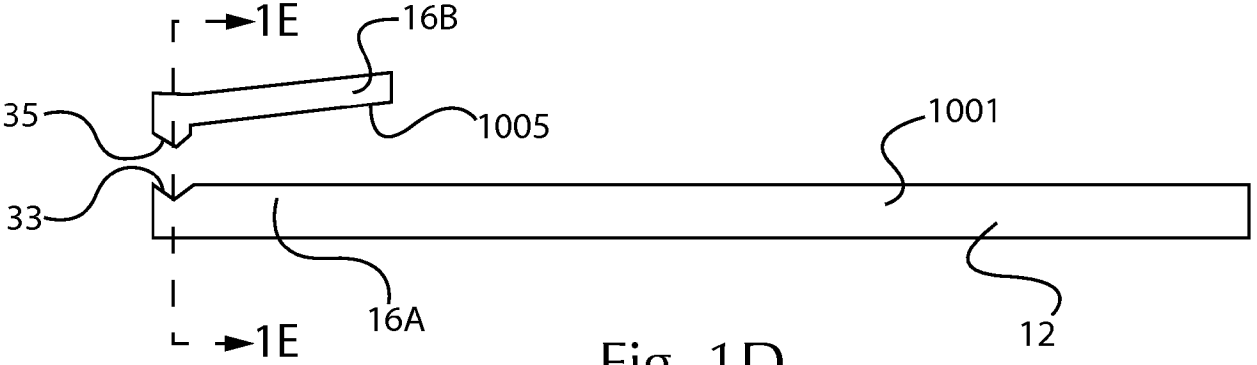
FIG. 1D is an exploded side view showing the toothbrush of FIG. 1A, the second head portion being separated from the body.
Figure 1E:
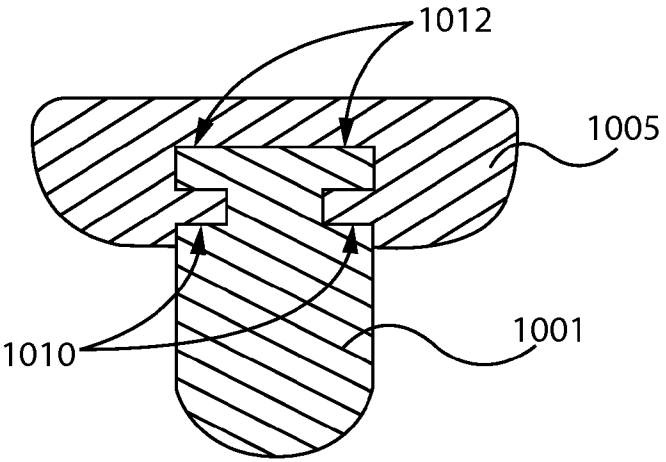
FIG. 1E is a cross sectional view showing an interface between a first head section and a second head section, the cross section being taken along line 1E-1E.

As shown in FIGS. 1D and 1E, the second head section 16B may be created via injection molding in a second step from a second material 1005, e.g. polypropylene, rubber, elastomers, blends thereof. In general, the second material will be different from the first material 1001. For example, because of the desirability of second head section 16B to have some flexibility, the second material 1005 may have a lower hardness than that of the first material 1001.

The second head section 16B may be injection molded onto the first head section 16A such that an engagement section 35 engages the receiving section 33 of the first head section 16A. If the second material 1005 is chosen to be compatible with the first material 1001, then the amount of engagement between the surface area of the receiving section 33 and the engagement section 35 may be sufficient to withstand the forces applied to the second head section 16B during brushing. However, as stated previously, the first head section 16A may be configured with a first undercut 1010, and the second head section 16B may be configured with a second undercut 1012. The first undercut 1010 may be positioned in the receiving section 33 of the first head section 16A. The second undercut 1012 may be positioned in the engagement section of the second head section 16B such that during the injection molding of the second head section 16B, the second undercut 1012 engages the first undercut 1010.

In general, the molding process for the second head section 16B would require a first mold half and a second mold half. The two mold halves would join together to create a cavity for the second head section 16B. Within these two mold halves, the first head section 16A would be positioned such that the second material 1005 would be deposited, in part, in the receiving section 33 of the first head section 16A. After the deposition of the second material 1005 for the second head section 16B was completed, the mold halves would be removed generally in a direction which is generally parallel to the transverse axis 115. However, the creation/utilization of undercuts may require the use of mold parts which move in both a lateral direction as well as the transverse direction.

Referring back to FIG. 1A, in order to reduce cycle times, the contact elements 20A may be mechanically attached to the first head section 16A via anchors or staples. Generally, the injection molding of the handle 12 and the neck 14 utilize a high pressure and rapid injection time. This approach can be realized with the utilization of the anchors or staples to mechanically attach the contact elements 20A to the first head section 16A.

However, if the contact elements 20A are being over injection molded as described with regard to FIG. 1C, then a low pressure and a slow injection time may be utilized. Also, because of the slower injection time, the material selected for the handle 12, neck 14, and first section 16A, should have a low viscosity. The lower pressure and slower injection time can reduce the likelihood that the first material 1001 bleeds through the holes in the mold bar which hold the contact elements being over-molded.

Embodiments are contemplated where the process described above is reversed. For example, the second head section 16B may be injection molded in a first step, and the handle 12, neck 14, and first head section 16A may be injection molded to the head in a second step. In these embodiments, the attachment between the first head section 16A and the second head section 16B may utilize undercuts as described heretofore or may utilize other suitable attachment mechanisms.

Figure 2A:
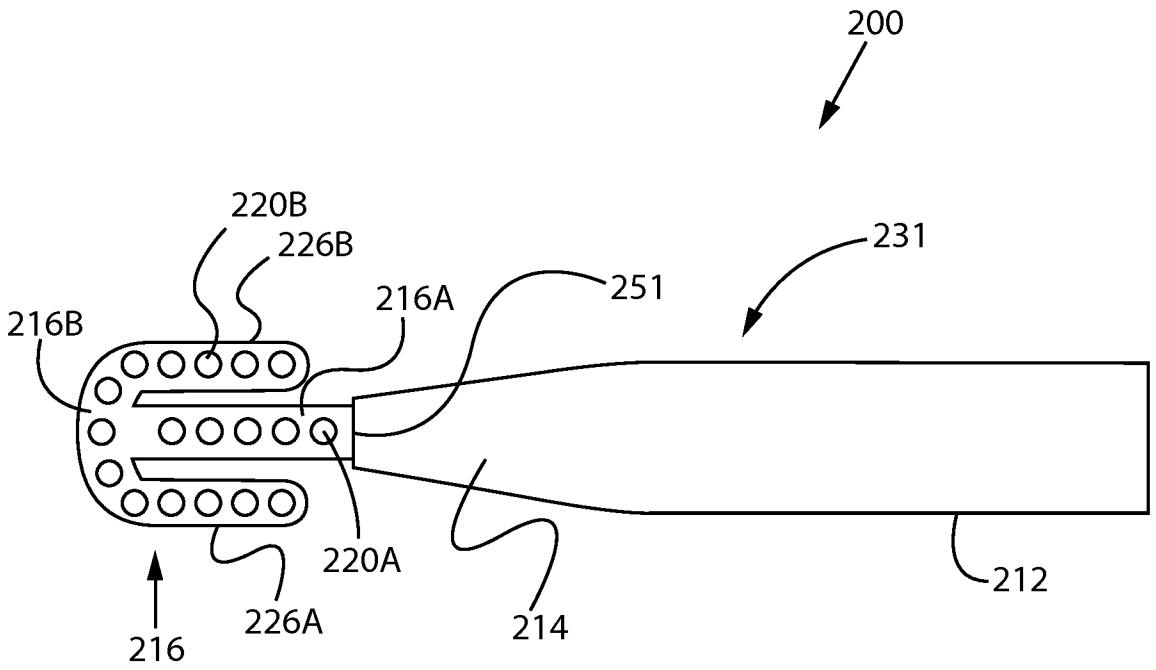
FIG. 2A is a plan view showing another embodiment of an oral hygiene implement, e.g. a toothbrush, constructed in accordance with the present invention.
Figure 2B:
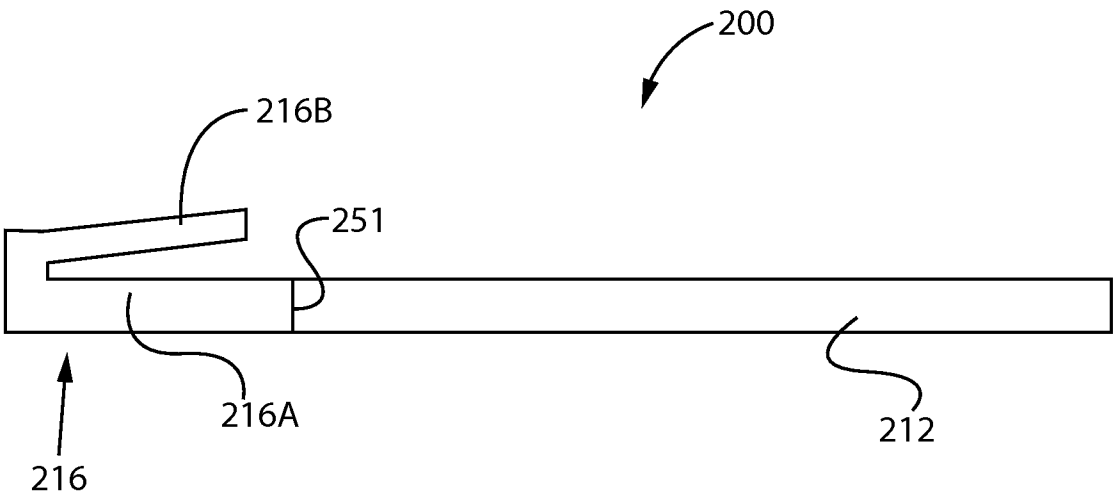
FIG. 2B is a side view showing the toothbrush of FIG. 2A.

Referring to FIGS. 2A and 2B, in another embodiment, a toothbrush 200 may comprise a handle 212, a head 216, and a neck 214 extending between the handle 212 and the head 216. The head 216 may comprise a first head section 216A and a second head section 216B. In some embodiments, the first head section 216A and the second head section 216B may be injection molded as one unit, i.e. unitary. The second head section 216B may comprise a first wing 226A and a second wing 226B which are disposed on either side of the first head section 216A. The first head section 216A may comprise a plurality of contact elements 220A, and the second head section 216B may comprise a plurality of contact elements 220B.

For those embodiments where the first section 216A and the second head section 216B are injection molded as one unit, the head 216 may attach to the neck 214 at an interface 251. The interface 251 may include an undercut on the neck 214 and/or the first section 216A. The undercut can help mechanically attach the head 216 to the neck 214.

In such embodiments, the handle 212 and neck 214, e.g. body 231, may be produced via a first injection molding step and the head 216 may be injection molded onto the handle 212/neck 214 at the interface 251. The surface area of the interface 251 can be increased in order to increase the strength of the attachment of the head 216 to the neck 214. For example, the interface 251 may be angled or may comprise detents on the neck 214 and/or head 216.

Figure 3A:
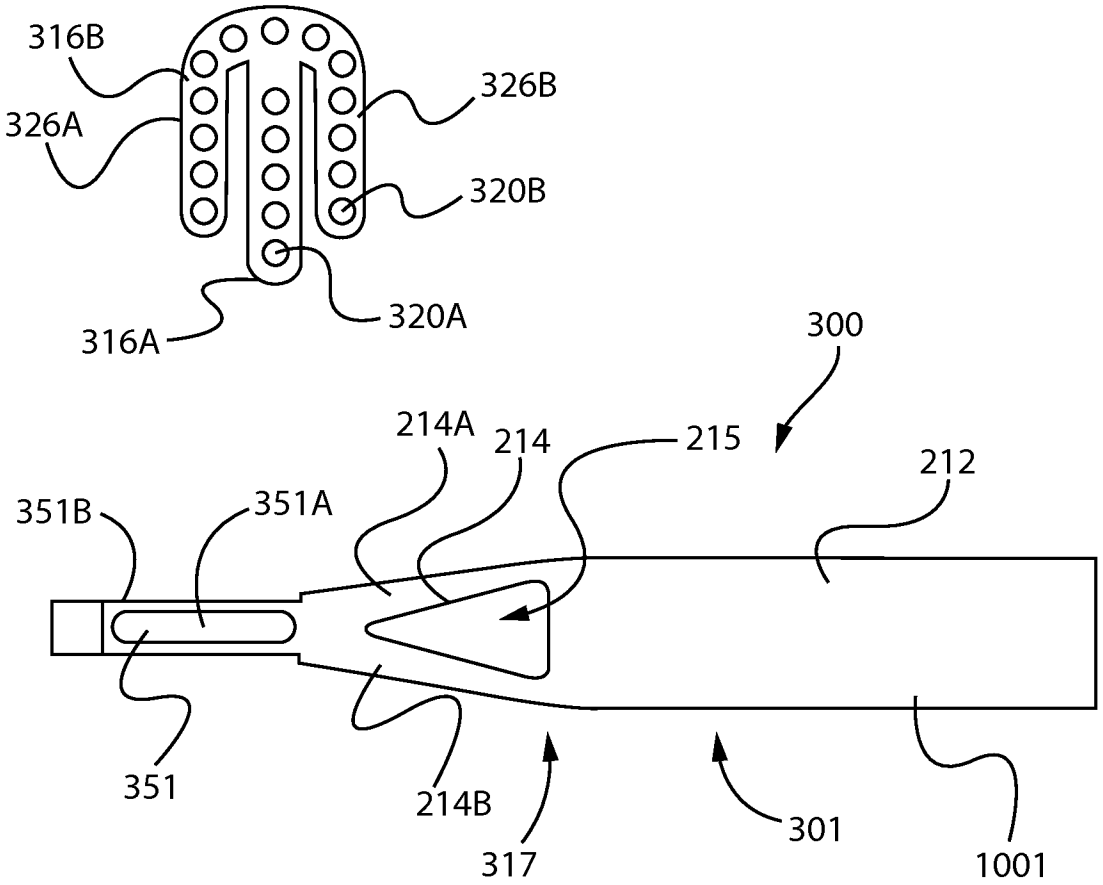
FIG. 3A is a plan view showing another embodiment of an oral hygiene implement, e.g. a toothbrush, a head being removed from a body for ease of explanation.
Figure 3B:
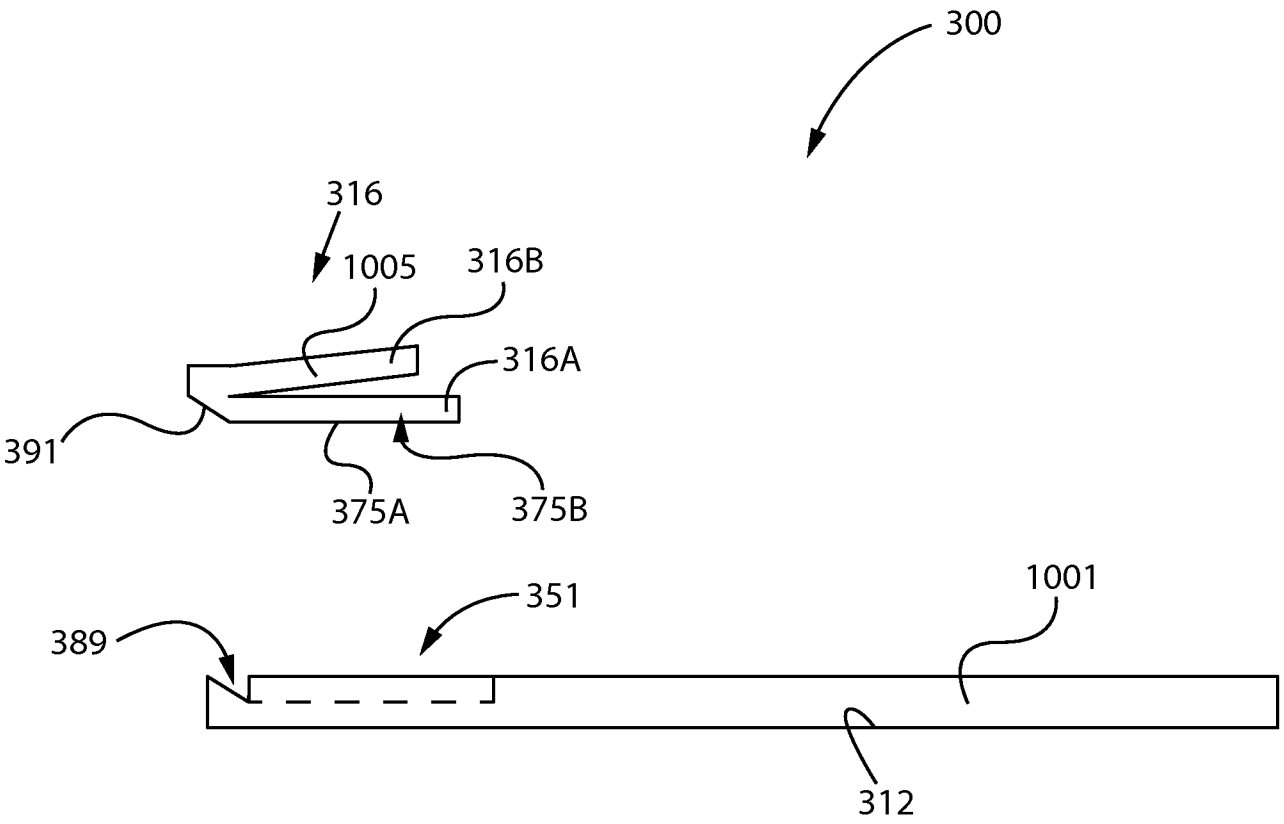
FIG. 3B is an exploded side view showing the toothbrush of FIG. 3A, the head being separated from the body.

Referring now to FIGS. 3A-3B, in another embodiment, a toothbrush 300 may comprise a handle 212, a head 316, and a neck 214 extending between the handle 212 and the head 316. The head 316 may comprise a first head section 316A and a second head section 316B. In some embodiments, the first head section 316A and the second head section 316B may be injection molded as one unit. The second head section 316B may comprise a first wing 326A and a second wing 326B which are disposed on either side of the first head section 316A. The first head section 316A may comprise a plurality of contact elements 320A, and the second head section 316B may comprise a plurality of contact elements 320B. The toothbrush 300 may comprise a longitudinal axis 111, a lateral axis 113, and a transverse axis 115, as described heretofore with regard to the toothbrush 10.

The second head section 316B may be disposed superjacent to the first head section 316A. Also, while the first head section 316A may be attached to the body 301, the second head section 316B or a portion thereof may be unattached to the body 301.

As shown a body 301 may comprise the handle 212, the neck 214, and a head support 317. The head support 317 may comprise a recess 351 therein. The recess 351 can be any suitable depth. The recess 351 may comprise a bottom surface 351A and a side surface 351B. Additionally, in some embodiments, the neck 214 may comprise an opening 215 extending from a front surface to a back surface of the toothbrush 300 thereby forming a first arm 214A and a second arm 214B.

In a particular process embodiment, the head 316 may be injection molded in a first step and the body 301 may be over injection molded in a second step. The over injection molding of the body 301 can be such that the bottom surface 351A of the recess 351 attaches to a bottom surface 375A of the first head section 316A. Similarly, the side surface 351B of the recess 351 may attach to a side surface 375B of the first head section 316A. This can result in an increase in contact surface area between the first head section 316A and the body 301 which can lead to a stronger bond between the first head section 316A and the body 301. Because of the increase contact surface area between the first head section 316A and the body 301, the attachment of the first head section 316A to the body 301 may occur without the use of undercuts on either the body 301 or the head 316. The elimination of undercuts can further simplify the injection molding process.

Any suitable contact surface area may be utilized to attach the first head section 316A to the body 301. In some embodiments, the contact surface area between the first head section 316A and the body 301 may be greater than or equal to about 100 square mm, 110 square mm, 120 square mm, 130 square mm, 140 square mm, 150 square mm, 160 square mm, 170 square mm, 180 square mm, 190 square mm and/or less than about 200 square mm, 190 square mm, 180 square mm, 170 square mm, 160 square mm, 150 square mm, 140 square mm, 130 square mm, 120 square mm, or any values within the ranges provided or any ranges within or comprising the values provided.

In embodiments, where the contact surface area is below 100 square mm, an adequate attachment may still be achieved between the first head section 316A and the body 301. For example, the first head section 316A may be attached to the body 301 at a plurality of locations. This can reduce the likelihood of stress being concentrated on a single point of attachment.

Additionally, the body 301 may comprise a receiving section 389 for receiving an engagement section 391 of the head 316. Also, because the bottom surface 351A and the bottom surface 375A are generally parallel to the longitudinal axis 111 (see FIG. 1A), an applied force to the head 316 will generally be distributed along the interface between the bottom surface 351A and bottom surface 375A. Because of the surface area of the interface, a very large force is generally required to create separation between the bottom surface 351A and the bottom surface 375A.

Figure 4A:
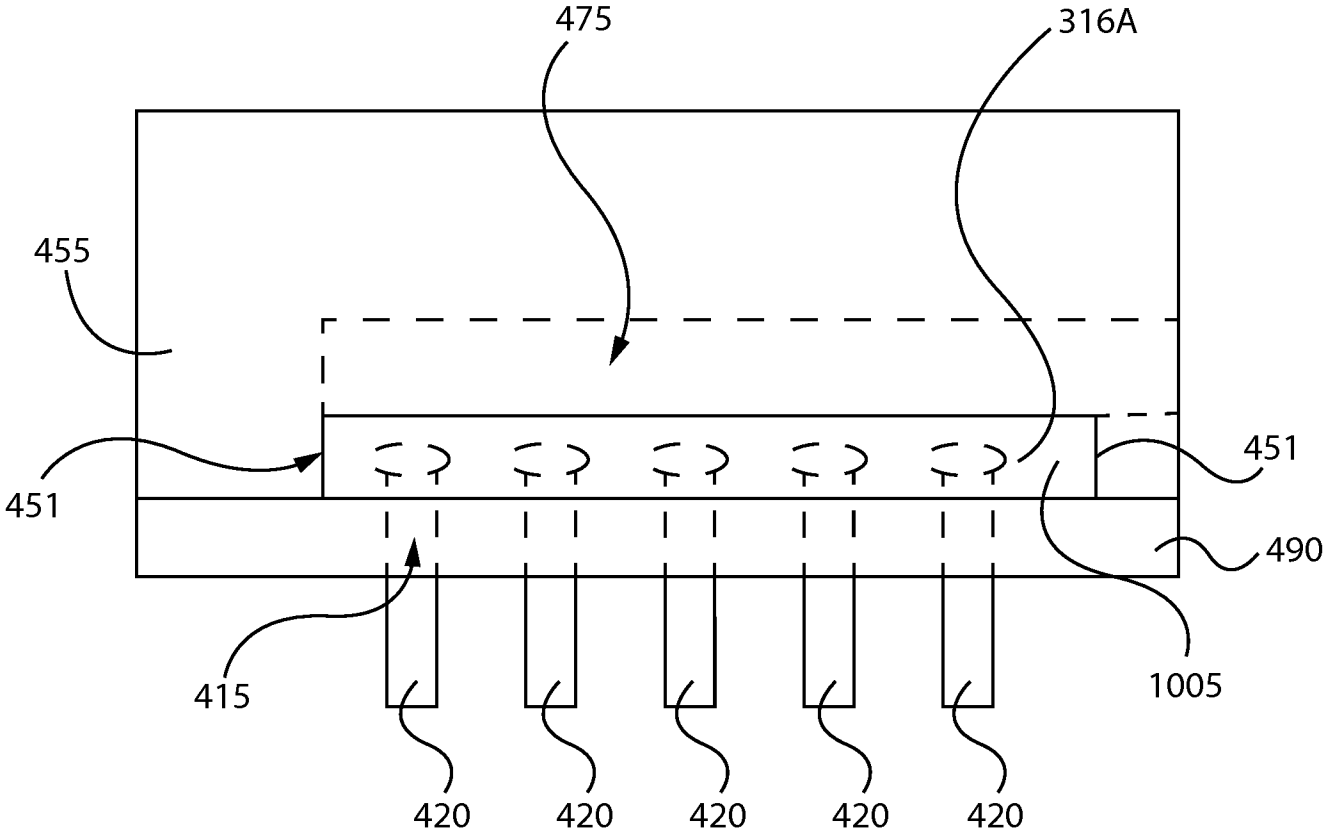
FIG. 4A is a cross sectional view showing a first head section in a mold portion, the mold portion being configured for over-molding the first head section.

Referring to FIGS. 3A, 3B, and 4A, in such processing one concern is with regard to the injection pressure utilized. As stated previously, the body 301 may be over injection molded to the head 316 using a first material 1001. Because higher injection pressures may be utilized for the first material 1001, the first material 1001 should not have access to holes 415 in which the contact elements 420 reside. In such embodiments, a second material 1005 for the first head section 316A and the mold portion 455 may create an effective boundary against the penetration of the first material 1001. Additionally, in some embodiments, an interface 451 between a mold portion 455 and the second material 1005 can create an effective boundary against the penetration of the first material 1001 into the holes 415 for the contact elements 420. As shown in FIG. 4, the mold portion 455 comprises a cavity 475 for the first material 1001.

Figure 4B:
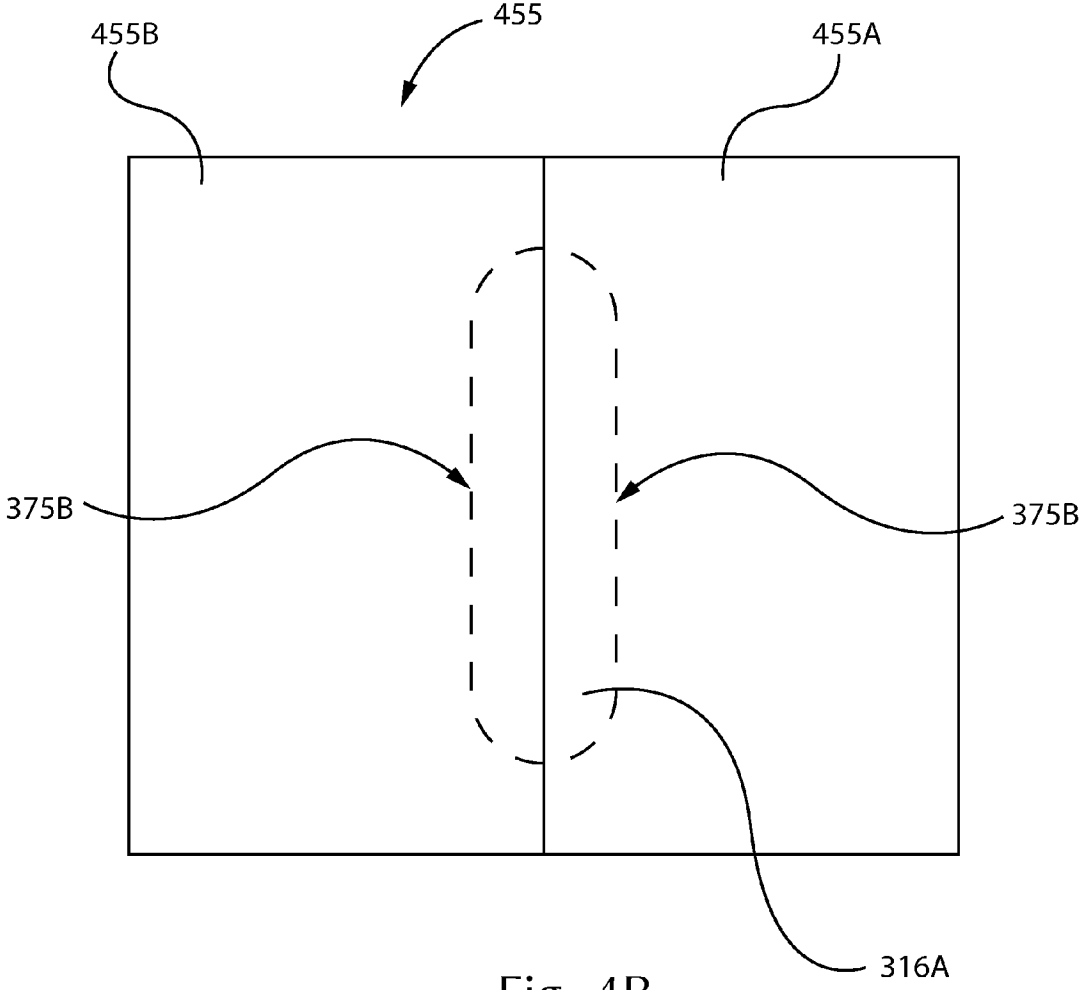
FIG. 4B is a top view showing the mold portion and first head section of FIG. 4A.

Referring to FIGS. 4A and 4B, the mold portion 455 may comprise a first half 455A and a second half 455B. The first half 455A and the second half 455B may engage the sides 375B of the first head section 316A such that the first material 1001 does not have access to the holes 415 in mold bar 490 through which the contact elements 420 extend.

In another process embodiment, the body 301 may be produced in a first injection molding step and the head 316 may be injection molded onto the body in a second injection molding step. Because of the reduced mass of the material used in the head, the cycle time of the process is not limited by the attachment of the bristle tufts. For example, as stated previously, where the contact elements are attached via overmolding to the body 301, lower viscosity materials, lower pressures, and slower injection times may be required. In contrast, in the embodiment for FIGS. 2A-2B, 3A-3B, and 4A and 4B, the head 316 may be produced unitarily. In such embodiments, because there are no contact elements attached to the body, the injection molding cycle for the body 301 may utilize higher viscosity materials, higher pressures, and faster injection times thereby reducing the cycle time of the process.

As used herein, the term "contact elements" is used to refer to any suitable element which can be inserted into the oral cavity. Some suitable elements include bristle tufts, elastomeric massage elements, elastomeric cleaning elements, massage elements, tongue cleaners, soft tissue cleaners, hard surface cleaners, combinations thereof, and the like. The head may comprise a variety of contact elements. For example, the first head section and/or the second head section may comprise bristles, abrasive elastomeric elements, elastomeric elements in a particular orientation or arrangement, e.g. pivoting fins, prophy cups, combinations thereof, or the like. Some suitable examples of elastomeric cleaning elements and/or massaging elements are described in U.S. Patent Application Publication Nos. 2007/0251040; 2004/0154112; 2006/0272112; and in U.S. Pat. Nos. 6,553,604; 6,151,745. The cleaning elements may be tapered, notched, crimped, dimpled, or the like. Some suitable examples of these cleaning elements and/or massaging elements are described in U.S. Pat. Nos. 6,151,745; 6,058,541; 5,268,005; 5,313,909; 4,802,255; 6,018,840; 5,836,769; 5,722,106; 6,475,553; and U.S. Patent Application Publication No. 2006/0080794.

The contact elements may be attached to the head in any suitable manner. Conventional methods include stapling, anchor free tufting, and injection mold tufting. For those contact elements that comprise an elastomer, these elements may be formed integral with one another, e.g. having an integral base portion and with a contact portion extending outward therefrom.

The head may comprise a soft tissue cleanser constructed of any suitable material. Some examples of suitable material include elastomeric materials; polypropylene, polyethylene, etc; the like, and/or combinations thereof. The soft tissue cleanser may comprise any suitable soft tissue cleansing elements. Some examples of such elements as well as configurations of soft tissues cleansers on a toothbrush are described in U.S. Patent Application Nos. 2006/0010628; 2005/0166344; 2005/0210612; 2006/0195995; 2008/0189888; 2006/0052806; 2004/0255416; 2005/0000049; 2005/0038461; 2004/0134007; 2006/0026784; 20070049956; 2008/0244849; 2005/0000043; 2007/140959; and U.S. Pat. Nos. 5,980,542; 6,402,768; and 6,102,923.

For those embodiments which include an elastomeric element on a first side of the head and an elastomeric element on a second side of the head (opposite the first), the elastomeric elements may be integrally formed via channels or gaps which extend through the material of the head. These channels or gaps can allow elastomeric material to flow through the head during an injection molding process such that both the elastomeric elements of the first side and the second side may be formed in one injection molding step.

The head(s) of the toothbrushes described herein may comprise any suitable material. Some examples of suitable materials include polypropylene (PP); polyethylene (PE); copolyesters; thermoplastic polyurethanes (TPU); thermoplastic elastomers (TPE), the like, or blends/combinations thereof. In embodiments where the head comprise a TPE, it may be beneficial for either the TPE or the overall blended material to have a Shore A hardness of greater than about 80.

The handle, neck, first head section (in some embodiments), and/or bodies described herein may comprise any suitable material. Some examples of suitable materials include PP, PE, copolyesters, TPU, the like or combinations thereof.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of producing a toothbrush comprising the steps of:

obtaining a plurality of filaments having a first end and a second end;

forming a melted mass of material at the second end of the filaments;

capturing the melted mass via injection molding of a first material, the injection molding of the first material forming a toothbrush head having a first head section and a second head section, wherein the first head section includes a bottom surface and a side surface and the second head section includes a first wing and a second wing;

wherein the first wing and second wing are disposed on either side of the first head section and extend above the first head section longitudinally in a direction towards a handle;

injection molding a second material over the first head section thereby forming a toothbrush body having the handle, a neck, and a head support;

wherein the toothbrush body includes a recess having a bottom surface and side surface; and wherein the bottom surface of the toothbrush body recess is in contact with the bottom surface of the first head section and the side surface of the toothbrush body recess is in contact with the side surface of the first head section.

2. The method of claim 1 further comprising the step of providing a contact surface area between the first head section and the head support which is greater than about 100 square mm.

3. The method of claim 2, wherein the contact surface area is greater than about 150 square mm.

4. The method of claim 2, wherein the contact surface area is between about 100 square mm to about 190 square mm.

* * * * *